United States Patent [19]

Anderson

[11] 4,006,619

[45] Feb. 8, 1977

[54] TUBE EXPANDER UTILIZING HYDRAULICALLY ACTUATED PISTONS

[76] Inventor: James Hilbert Anderson, 1615 Hillock Lane, York, Pa. 17403

[22] Filed: Aug. 7, 1975

[21] Appl. No.: 604,023

[52] U.S. Cl. ..... 72/54; 72/58

[51] Int. Cl.[2] ..... B21D 22/10

[58] Field of Search ..... 72/58, 59, 54, 61, DIG. 8

[56] References Cited

UNITED STATES PATENTS

| | | | |
|---|---|---|---|
| 701,549 | 6/1902 | Deerins | 72/58 |
| 1,548,730 | 8/1925 | Mirfield | 72/54 X |
| 2,370,840 | 3/1945 | Carlson | 72/54 |
| 2,458,854 | 1/1949 | Hull et al. | 72/58 |
| 2,796,109 | 6/1957 | Wood | 72/59 |

*Primary Examiner*—Leon Gilden
*Attorney, Agent, or Firm*—Kemon, Palmer & Estabrook

[57] ABSTRACT

An apparatus for expanding a tube or pipe by axially compressing an annular resilient element to cause said element to radially expand into engagement with the inner surface of the tube or pipe. The compressing of the resilient element and its radial expansion is caused by a main piston and cylinder structure which is subjected to fluid under pressure. A secondary or impact piston is provided in the main piston for applying higher stresses to the tube or pipe through the resilient element. The resilient element is interposed between a plurality of spaced annular ring members which constitute guide means therefor.

9 Claims, 10 Drawing Figures

FIG.4
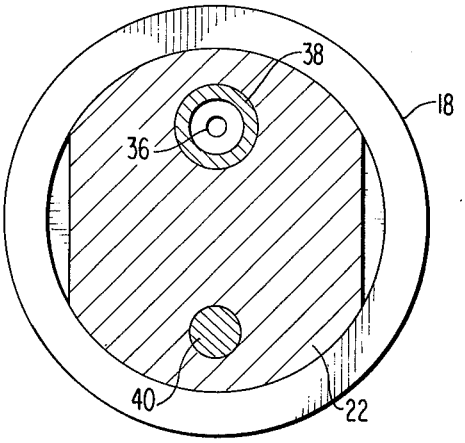
FIG.5
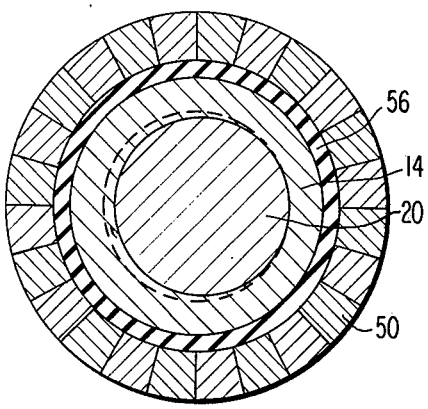
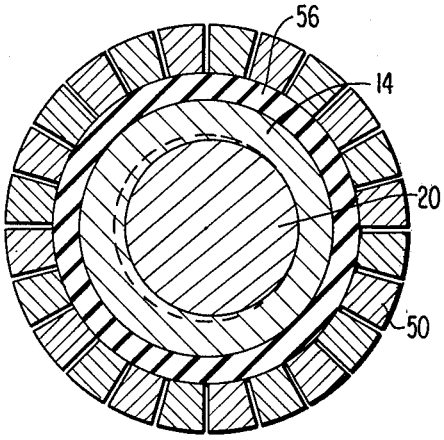
FIG.6
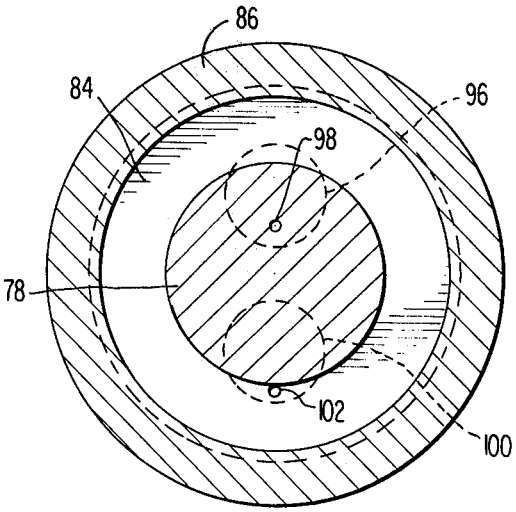
FIG.10

TUBE EXPANDER UTILIZING HYDRAULICALLY ACTUATED PISTONS

BACKGROUND OF THE INVENTION

The present invention is directed to the deforming of metallic members, such as pipes or tubes, by the application of a fluent medium or energy field to said members.

The deforming or expanding of a metallic member, whether it be a metallic sheet, pipe or tube, has been carried out by various and sundry methods. The deforming of metal sheets so as to produce corrugations is illustrated in the patents to Ruttes U.S. Pat. NO. 2,960,141 of Nov. 15, 1960, and Amochowski U.S. Pat. No. 3,068,932 of Dec. 18, 1962, wherein die members having a convolute surface are adapted to receive the metal sheets under the action of pistons subjected to fluid pressure. It has been known to use resilient elements in conjunction with pistons under pressure for corrugating metal sheets or tubes. The patents of Dreyer U.S. Pat. No. 1,879,663 of Sept. 27, 1932, and Wurzburger U.S. Pat. No. 2,603,175 of July 15, 1952, show the deforming of metallic members formed of brass, aluminum, soft copper of the like wherein a die member is utilized in conjunction with a resilient element and at least one piston or ram member.

While the prior art has shown the broad general concept of deforming a metallic member, such as a sheet or tube, through the use of a resilient member under pressure from a piston or ram the end results have not always proven to be satisfactory in all respects. In certain instances when the metallic member was not of the soft or relatively pliable type the resilient element under pressure of the piston or ram would tend to extrude or flatten out along the face or surface of the metallic member to such a degree that there would be only a slight deformation of the metal member. Such a situation would be highly undesirable in attempting to secure an end portion of one tubular metallic member to another. Therefore, it becomes highly desirable that the radial expansion of the resilient element be controlled or guided in such a manner as to insure that the force imparted thereto is directed against the metallic member in a manner that will insure the proper deforming of the metallic member.

SUMMARY OF THE INVENTION

The present invention is directed to an apparatus utilizing a main or primary piston and cylinder combination for axially compressing a resilient element or member and causing same to expand radially. The expansion of the resilient element into engagement with a metallic member will result in the deforming of said metallic member to where it could be forced into engagement with another metallic member for effectively joining the metallic members to one another.

The tube expander of the present invention is readily susceptible of use in securing one end of a pipe or tube to an end of another pipe or tube. The main piston and cylinder is capable of axially compressing a resilient element and causing same to expand radially for forcing the inner tube into engagement with the outer tube. The resilient element is confined between sets of guide or back-up ring members which have a different modulus of elasticity from that of the resilient element and thus insure that the force of the radial expansion of the resilient element is directed against the inner surface of the inner tube.

A secondary piston is mounted in and carried by the main piston and same is capable of imparting to the fluid acting on the main piston a sudden impact. The fluid acting on the main piston, for causing a compressing of the resilient element and its radial expansion, may have a high substantially instantaneous pressure applied thereto as a result of a sudden blow being imparted to the secondary piston. This force applied to the secondary piston permits a higher pressure to be applied to the resilient element and a further radial expansion of same resulting in considerably higher stresses being applied to the tube thereby permitting tighter seating of the tube in the bore of the other tube or pipe.

The concept of the present invention is also adaptable to the expanding of tubes or the like into engagement with a tube sheet or header to produce a very effective sealing engagement therebetween. In such an operation the cylinder and piston size is not limited by the inner diameter of a pipe or tube so that a single cylinder and piston may be employed wherein the diameter of the cylinder is larger than the area of the resilient element resulting in a greater pressure on the resilient element than the pressure of the fluid acting on the piston. In a device of this type the resilient element is retained between sets of guide or back-up ring members.

BRIEF DESCRIPTION OF THE DRAWINGS

FIG. 4 is a vertical sectional view of the expander unit, the view being taken on the line 4—4 of FIG. 1.

FIG. 5 is a vertical sectional view of the expander unit showing the end rings in a non-expanded condition, the view being taken on line 5—5 of FIG. 3;

FIG. 6 is a view similar to FIG. 5 showing the end ring in an expanded condition;

FIG. 10 is a vertical sectional view of the tube expander, the view being taken on the line 10—10 of FIG. 7.

DESCRIPTION OF THE PREFERRED EMBODIMENT

Figure 1:
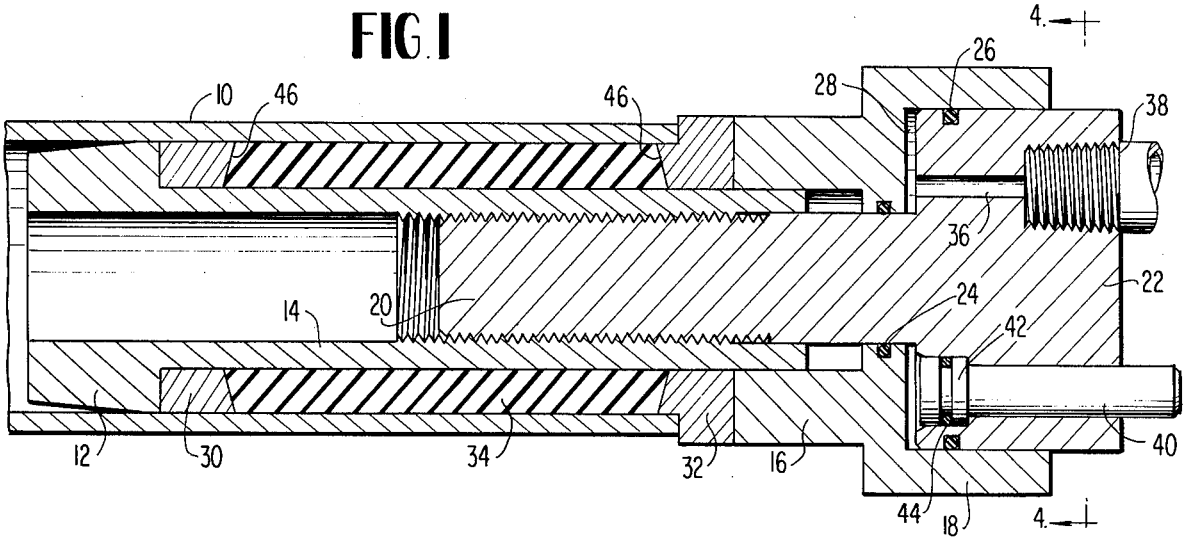
FIG. 1 is a longitudinal section view of an expander unit of the present invention positioned within a tube or pipe.

There is shown in FIG. 1 a tubular conduit or pipe 10 which has slidably positioned therein an expander unit of the present invention including a circular base member 12 whose diameter is commensurate with the inner diameter of the tubular conduit or pipe 10. The base member 12 has projecting from one face thereof, in a plane normal thereto, an elongated hollow stem or sleeve 14 which has its free end slidably disposed within the forward reduced end portion 16 of a cylinder or housing 18. The hollow stem or shank 14 has threaded therein a piston rod 20 that extends through the reduced portion 16 of the cylinder 18 and terminates in a piston 22 that is slidably disposed within the cylinder 18. The cylinder 18 is provided with a conventional "O"-ring seal 24 which is adapted to engage the piston rod 20 while the piston 22 is provided with a conventional O-ring seal 26 that engages the inner surface of the cylinder 18 in order to effectively seal the fluid chamber 28 provided between the base of the cylinder 18 and the face of the piston 22.

The stem or sleeve 14 has mounted thereon adjacent the base member 12 an annular disc or band 30 while a second annular disc or band 32 is mounted on the stem or sleeve 14 in abutting engagement with the reduced end portion 16 of the cylinder 18. The stem or shank 14 has positioned thereon intermediate the annular discs 30 and 32 an annular sleeve or ring 34 formed from an elastomer material such as polyurethane. As clearly shown in FIG. 1 the outer surface of the disc 30 and the sleeve or ring 34 in their unexpanded condition are in engagement with the inner surface of the tube or pipe 10 while the inner end of said tube or pipe 10 is arranged to overlie a reduced portion of the annular disc or band 32 with the end of the tube or pipe 10 being disposed in abutting engagement with an enlarged portion of the annular disc or bead 32.

The main piston 22 is formed with a passageway 36 that communicates with the fluid chamber 28 and the threaded end 38 of a fluid line that is connected to said piston. The piston 22 is provided with a secondary or impact piston that is formed with a piston stem 40 that is slidably disposed in a suitable passageway in the main piston and arranged to extend outwardly from said main piston. The piston stem 40 terminates in a piston head 42 which is positioned within a suitable recess provided in the upper face of the piston 22 so that the piston head engages the bottom of said recess to prevent the withdrawal of the secondary piston from the main piston 22. The piston head 42 of the secondary piston is provided with a conventional O-ring 44 to seal against leakage of fluid past the piston head 42 in the recess provided in the upper face of the main piston 22.

It is to be noted that the annular discs or bands 30 and 32 mounted on the stem or sleeve 14 are formed from a material having a modulus of elasticity that is lower than the high-strength material, such as steel, which is usually employed in making the cylinder 18 and stem or sleeve 14. The sleeve or ring member 34, being formed from an elastomer material such as polyurethane, rubber or similar material, is susceptible of being compressed axially so as to cause said ring or sleeve to expand radially and while the annular discs 30 and 32 tend to embrace and confine the annular ring or sleeve member 34 said annular discs 30 and 32 are capable of some radial expansion upon the application of compressive forces so that said discs tend to act at all times as guides for the ring or sleeve member 34. As the annular sleeve or ring member 34 expands outwardly into engagement with the tube 10 and forces the tube to expand radially outwardly there tends to be an annular slot or space formed between the outer diameter or face of the annular discs or bands 30 and 32 and the inner face of the tube or pipe 10. The radial expansion of the annular sleeve or ring 34 upon the axially compressing of said annular sleeve or ring will result in said annular sleeve or ring 34 having a tendency under such high pressure to extrude through the annular slot between the inner face of the pipe or tube 10 and the outer surface of the bands 30 and 32.

In order to overcome the foregoing shortcoming, the inner faces of the annular discs or bands 30 and 32 are provided with a tapered surface 46 which surface may be at a taper of approximately 15° with respect to a plane that is normal to the longitudinal axis of the piston rod 20. The formation of the annular discs or bands 30 and 32 with the tapered surface 46 results in a combined radial pressure outward on the annular discs or bands as the elastomeric sleeve or ring 34 is compressed. Since the component of force is such that the discs or bands 30 and 32 create a reactive force inward on the elastomeric material of the sleeve or ring 34 at the ends of said ring then this force tends to reduce the chance of the elastomeric sleeve or ring at the ends thereof from expanding as much as the sleeve or ring expands in the mid-section thereof and this arrangement reduces the chance or possibility of the sleeve or ring 34 from extruding through the annular slot that might develop between the inner surface of the tube or pipe 10 and the outer face of the annular discs or bands 30 and 32. Thus the tapered surfaces provided on the inner faces of the annular disc or band elements 30 and 32 tend to insure that all of the radial expansive forces developed within the annular sleeve or ring member 34 are directed against the inner surface of the tubular conduit or pipe 10 so that any tendency of the annular ring member 34 to extrude along the inner surface of the tubular conduit or pipe 10 is either prevented or materially restricted.

Figure 2:
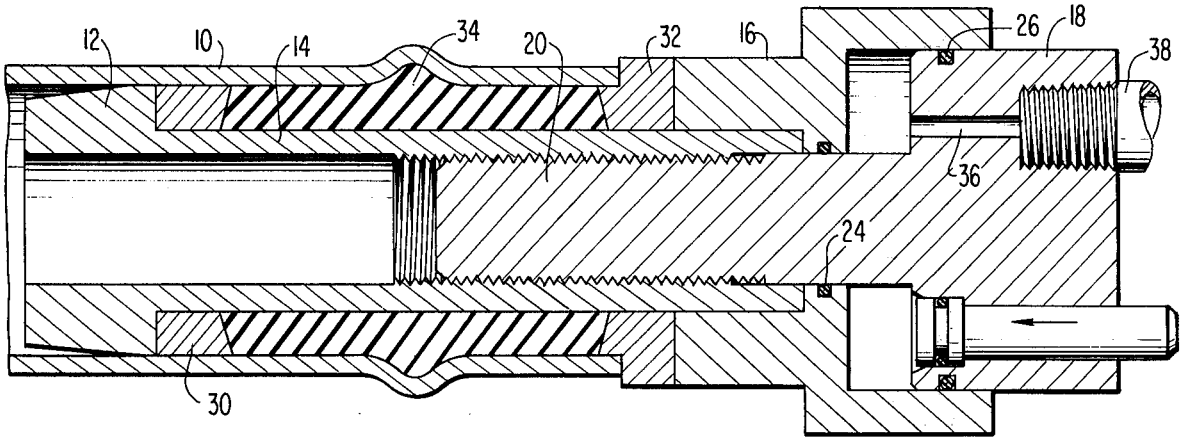
FIG. 2 is a view similar to FIG. 1 showing the expander unit in an operative condition with an area or portion of the tube expanded.

In the use of the tube expander shown in FIGS. 1 and 2 the unit is slidably inserted into a tubular conduit or pipe 10 and a fluid line 38 that is attached to a pump or the like, not shown, is connected to the threaded aperture in the piston 22 whereby fluid under pressure will be delivered to the fluid chamber 28 by way of the fluid passageway 36. The fluid under pressure in the chamber 28 will cause the piston 22 to be moved towards the right, when viewing FIG. 1, while the cylinder 18 and its reduced end portion 16 is moved to the left and this action will tend to draw the base member 12 and the stem or sleeve 14 to the right or towards the head of the cylinder so as to compress the resilient annular ring member 34 between the annular disc or band member 30 and 32. This axial compression of the annular sleeve or ring member 34 will be increased by the fluid entering the chamber 28 and thus cause a radially expansion of the annular sleeve or ring member 34 to the position wherein said ring member will force the tube 10 outwardly in the manner as illustrated in FIG. 2.

As the annular sleeve or ring member 34 is expanded against the tubular conduit or pipe 10 at or near its limit of expansion, as indicated in FIG. 2, then the secondary piston 40–42 may be struck by a hammer or mallet which action produces a high, almost instantaneous, pressure on the entire system and which action further helps to radially expand the annular sleeve or ring member 34 into engagement with the tube 10 for applying higher stresses to the tube in deforming same.

Figure 3:
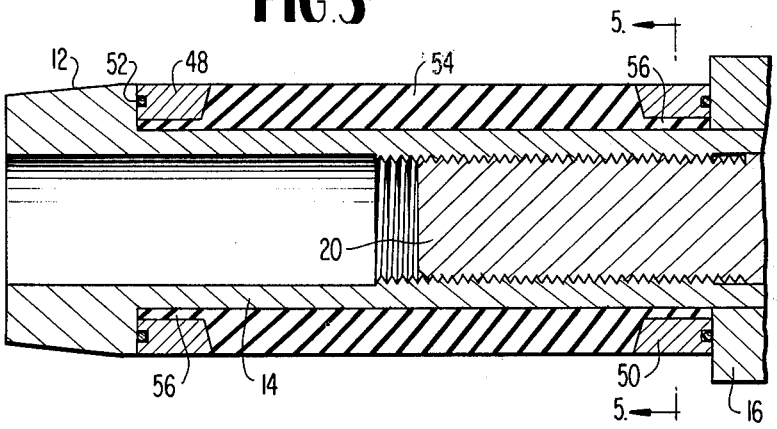
FIG. 3 is a longitudinal sectional view of a portion of an expander unit of the present invention and showing a modification of the end rings associated with the expandable ring.

In the modification shown in FIG. 3 the parts therein corresponding to those shown in FIGS. 1 and 2 are identified by the same reference numerals. In FIG. 3 the annular disc or band members 48 and 50 are made of segments. The segmented rings 48 and 50 may be made with saw slots through it and made into an even number of sector shaped pieces, such as shown in FIG. 5 in its contracted position. These segmented rings or disc members 48 and 50 can be made of high-strength steel and when contracted are held in place by an O-ring 52 disposed in a slot at the side of the various segments and which O-ring acts as a retainer to prevent the segments from falling out of the expander and yet facilitates the retention of the rings while the expander unit is being inserted into a tubular pipe or conduit.

As shown in FIG. 3 the annular sleeve or ring 54 that is positioned between the annular bands or disc members 48 and 50 is formed with reduced end portions 56 that are interposed between the stem or sleeve 14 and the annular band or disc members 48 and 50. In addition the face of the resilient annular sleeve or ring member 54 is provided with an inclined or tapered surface that engages a complementary type surface provided on the annular band or disc members 48 and 50 in a manner somewhat analogous to the surfaces provided on the annular band and disc members and the resilient ring of FIGS. 1 and 2.

The tube expander as shown in FIG. 3 in its assembled form is inserted into a suitable conduit or pipe, such as the conduit or pipe 10 of FIG. 2, and the elastomer sleeve or ring member 54 is expanded in the same manner as the ring member 34 of FIG. 2 so that the ring member 54 is pushed outwardly against the inner wall or face of the tube for the purpose of radially expanding the tube. As the annular elastomer ring or sleeve member 54 is expanded it pushes the segments of the annular band or disc members 48 and 50 outwardly against the inner wall or face of the tube and such action eliminates a space or slot being formed or developed between said disc members and the inner face of the conduit or tube and through which the polyurethane might extrude. As the segments of the annular band or disc members 48 and 50 expand radially outward the slots between the adjacent segments of said band or disc members would only open to a dimension of approximately 3.14 divided by 24 times the diametral clearance of the ring in the bore of the tube or conduit. This expansion of the segments means that the individual slots are very small or tiny in thickness compared to the radial thickness of the clearance between the annular bands or disc members on the expander and the bore of the tube. Thus there is very little opportunity for extrusion of the elastomer into the slots of the segmented annular band or disc members when in its expanded condition. The expansion of the segments of the annular band or disc member is illustrated in FIG. 6.

Figure 7:
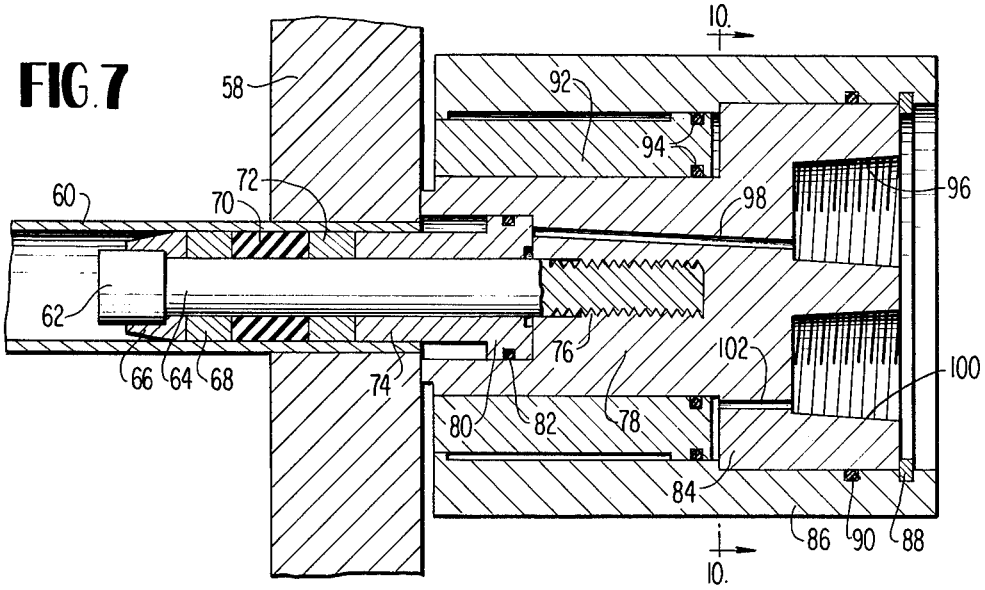
FIG. 7 is a longitudinal sectional view showing a tube expander of the present invention positioned within a tube in a tube sheet or header.
Figure 8:
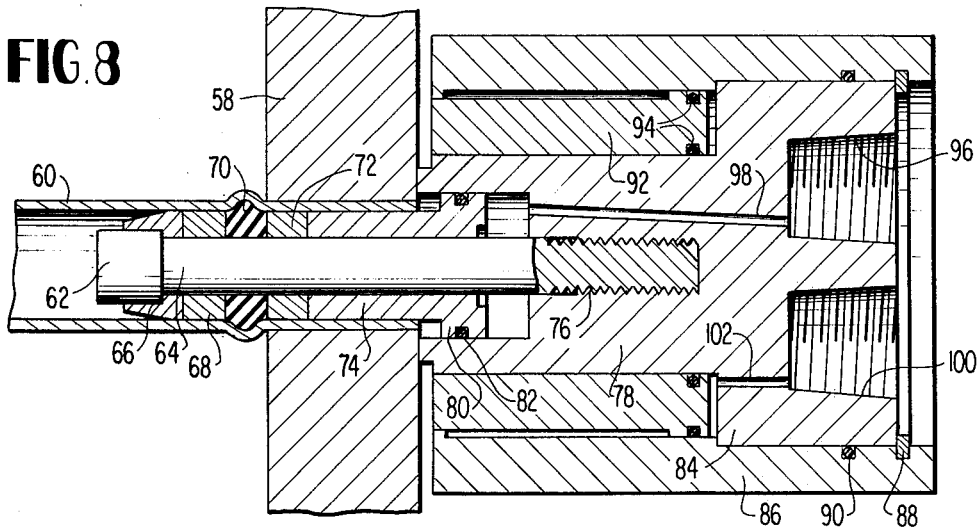
FIG. 8 is a view similar to FIG. 7 showing the tube expander in an operative position.
Figure 9:
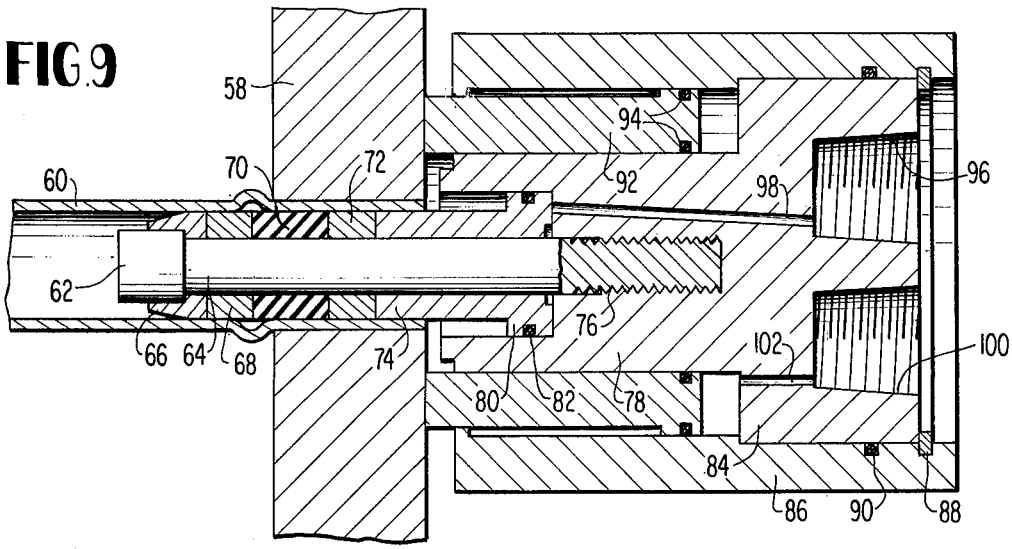
FIG. 9 is a view similar to FIG. 8 showing the manner of removing the expander unit from a tube in a tube sheet.

In the mounting or positioning of a plurality of tubes or pipes within the tube sheet or header the principal of expanding a tube by axially compressing a resilient member to cause same to expand radially in the manner as illustrated in FIGS. 1 through 3 may be readily adopted and such a structure is shown in FIGS. 7 through 9. There is shown in FIG. 7 a tube sheet or header 58 which has a tubular conduit or pipe 60 positioned therein with a tube expander unit of the present invention disposed within said tubular conduit. The tube expander is provided with a circular end member 62 that has an elongated stem or shank portion 64 extending therefrom. The end member 62 has an adaptor ring 66 positioned thereon and said ring constitutes an abuttment or support for and annular band or disc member 68 which is positioned upon the elongated stem or shank 64. The end member 62 may be formed of a size commensurate with the internal diameter of the tubular conduit or pipe so that the use of the adaptor 66 could be dispensed with and the annular band or disc member 68 could then abutt the end member 62 in the manner similar to that as shown in FIGS. 1 and 2. The stem or shank member 64 also has positioned thereon a resilient sleeve or ring member 70 formed of some suitable elastomeric material and also has another annular band or disc member 72 positioned thereon in abutting engagement with the resilient sleeve or ring member 70. While the annular band and disc members 68 and 72 as well as the resilient sleeve or ring member 70 as shown in FIG. 7 are similar to those illustrated in FIGS. 1 and 2 it is readily apparent that said annular band or disc members and resilient ring member could be of the type as illustrated in FIG. 3.

The stem or shank member 64 extends through a piston 74 which is mounted on said stem for sliding movement with respect thereto. The outer or free end of the stem or shank portion 64 is threadedly secured in a suitable recess 76 provided in a cylindrical member 78. The piston 74 is formed with an enlarged head portion 80 which is slidably positioned within the cylinder 78. The enlarged head portion 80 is formed with a peripheral annular groove in which is mounted an O-ring member 82 so as to provide an effective sealant between the enlarged head portion 80 of the piston and the walls of the cylinder 78. The cylinder 78 is formed with an enlarged end portion 84 that has a concentrically disposed housing member 86 secured thereto by an expansion ring 88. The enlarged portion 84 of the cylinder 78 is formed with a peripheral annular groove for the reception of an O-ring member 90 to provide an effective seal between the housing member 86 and the enlarged portion 84 of the cylinder 78. The housing member 86 is spaced from the reduced forward portion of the cylinder 78 to define a space for the reception of an annular piston 92 which is provided with internal and external annular grooves for the reception of O-rings 94. The enlarged portion 84 of the cylinder 78 is formed with a threaded aperture 96 which communicates with the face of the enlarged head portion 80 of the piston 74 by means of a passageway 98. The enlarged portion 84 of the cylinder 78 is also provided with a second threaded aperture 100 which communicates with the head of the piston 92 by means of a fluid passageway 102. The apertures 96 and 100 are both connected by suitable lines, not shown, to a source of fluid under pressure such as a hydraulic pump or the like, not shown.

In the use of the expander unit illustrated in FIGS. 7 through 9 the tube or pipe 60 is inserted into the tube sheet or header 58 and then the expander unit is slidably inserted into said tube or pipe until the cylindrical member 78 abutts the tube sheet or header 58. With the expander unit so positioned within the tube or pipe 60 fluid is then directed through the passageway 98 from the aperture 96 and against the enlarged head portion 80 of the piston 74 so as to move said piston to the left, when viewing FIG. 7. This action tends to compress the resilient annular ring member 70 in an axially direction which causes said ring member to expand radially so as to force the tube outwardly in the area and the manner as clearly shown in FIG. 8. It is to be noted that the tube expander unit shown in FIGS. 7 and 8 utilizes a piston having an enlarged head portion 80 which is of a greater diameter than the diameter of the tube or pipe 60 and this arrangement permits the raising of the pressure on the compressible annular sleeve or ring member 70 to a point that is higher than the pressure of the hydraulic fluid flowing through the passageway 98. In addition the inclined or tapered surfaces provided on the faces or ends of the annular band or disc members 68 and 72, that engage said resilient sleeve or ring member 70, tends to cause a combined radial outward pressure on said resilient sleeve or ring member as the elastomeric material of said sleeve or ring member is compressed.

After the tubular member 60 has been expanded in the manner as clearly shown in FIG. 8 the pressure of the fluid delivered to the aperture 96 is reduced which action permits the piston 74 to move towards the right in the cylinder 78 under the resilient action of the annular sleeve or ring member 70. In order to insure the ready removal of the expander unit from the tube or pipe 60 fluid is next delivered to the aperture 100 and in turn to the head of the annular piston 92 by way of the passage 102 so as to force said annular piston 92 towards the left, when viewing FIG. 9, and into engagement with the tube sheet or header structure 58. This engagement of the piston 92 with the tube sheet or header 58 and the continued application of fluid pressure against the head of the annular piston 92 results in a reaction pressure being imparted against the tube sheet or header structure 58 which initiates a withdrawal of the expander unit from the tube or pipe 60. This use of the annular piston 92 as a retractor piston permits the ready withdrawal of the tube expander unit from the tubular member 60 as quite often the reduction of pressure in the fluid passageway 98 does not result in a complete release of the expander unit from the tube or pipe 60. The retraction or return of the annular sleeve or ring member 70 as well as the annular band or disc members 68 and 72 to their initial or original condition might not be complete so that a manual withdrawal of the expander unit would be rather difficult form the tube or pipe 60. The expansion of the tubular piston 92 with respect to the cylinder 78 causes said piston to be moved against the tube sheet or header and the pressure that is applied to said piston effects an initial withdrawal of the expander unit from the tubular member 60 as it tends to break the binding or retentive engagement of the expander unit with respect to said tube or pipe. Such an arrangement assures the ready removal of the expander unit from the tube or pipe 60.

Although the foregoing description is necessary of a detailed character, in order that the invention might be completely set forth, it is to be understood that the specific terminology is not intended to be restrictive or confining, and that various rearrangements of parts and modifications of detail may be resorted to without departing from the spirit or scope of the invention herein embodied or claimed.

What I claim:

1. Apparatus for radially expanding an area of a tubular conduit or pipe comprising an expander unit positioned within said tubular conduit or pipe, said unit having a member with a stem portion arranged in coaxial relationship with said tubular conduit or pipe, a compressible ring element mounted on said stem portion, a cylinder member, a piston member slidably positioned within said cylinder member, said stem portion connected to one of said last mentioned members, a band element positioned on said stem portion between said ring element and said member and a band element positioned on said stem portion between said ring element and one of said last mentioned members, said band elements having a higher modulus of elasticity than said compressible ring element but less than that of said member and said one of said last mentioned members, and means for delivering fluid under pressure to said cylinder member for moving said piston member with respect thereto for axially compressing said ring element between said band elements contemporaneous with the radial expansion of an area of said tubular conduit or pipe by said ring element.

2. Apparatus for radially expanding an area of a tubular conduit or pipe as set forth in claim 1 wherein said annular band elements are formed with a tapered surface for engaging a complementary surface provided on the ends of said annular ring element.

3. Apparatus for radially expanding an area of a tubular conduit or pipe as set forth in claim 1 wherein said band elements are formed of segments with means engaging said segments to retain them in abutting engagement with said annular resilient sleeve or ring and said member and said cylinder member.

4. Apparatus for radially expanding an area of a tubular conduit or pipe as set forth in claim 1 wherein said piston member is bored and counterbored to receive a secondary piston and piston rod with means carried by said piston to insure its retention in said piston member.

5. Apparatus for radially expanding an area of a tubular conduit or pipe as set forth in claim 1 wherein said piston member is provided with a secondary piston slidably positioned therein, said secondary piston having force applied thereto for delivering an impact to the fluid in said cylinder and imparting a high instantaneous pressure to said ring member.

6. Apparatus for radially expanding an area of a tubular conduit or pipe as set forth in claim 1 wherein said stem portion is connected to said piston member and said ring member is compressed axially between said member and said cylinder member.

7. Apparatus for radially expanding an area of a tubular conduit or pipe as set forth in claim 1 wherein said stem portion is connected to said cylinder member and said ring member is compressed axially between said member and said piston member.

8. Apparatus for radially expanding an area of a tubular conduit or pipe as set forth in claim 7, wherein a holder is provided for said tubular conduit, said cylinder member abutting said holder and said piston member moves towards said annular member to radially expand said ring member and tubular conduit to retain said tubular conduit in said holder.

9. Apparatus for radially expanding an area of a tubular conduit or pipe as set forth in claim 8 wherein said cylinder member is positioned within a housing and a second piston member is interposed between said cylinder member and housing with fluid means for forcing said second piston against said holder to retract said expander unit including said piston member from said tubular conduit.

* * * * *